US005375974A

United States Patent [19]

Heinrich

[11] Patent Number: 5,375,974

[45] Date of Patent: Dec. 27, 1994

[54] STABILIZING DEVICE FOR EXTENDING THE CHARACTERISTIC DIAGRAM OF A COMPRESSOR

[75] Inventor: Klaus Heinrich, Nussbaumen, Switzerland

[73] Assignee: Asea Brown Boveri Ltd., Baden, Switzerland

[21] Appl. No.: 153,427

[22] Filed: Nov. 16, 1993

[30] Foreign Application Priority Data

Dec. 8, 1992 [DE] Germany ..... 92120867

[51] Int. Cl.[5] ..... F04D 29/66

[52] U.S. Cl. ..... 415/182.1; 415/206; 415/119; 416/190

[58] Field of Search ..... 416/188, 190; 415/206, 415/228, 182.1, 119

[56] References Cited

U.S. PATENT DOCUMENTS

| | | | |
|---|---|---|---|
| 2,594,042 | 4/1952 | Lee . | |
| 4,363,601 | 12/1982 | Leskinen | 416/188 |
| 4,648,796 | 3/1987 | Maghenzani | 416/188 |
| 5,105,616 | 4/1992 | Bornemisza . | |
| 5,304,033 | 4/1994 | Tang | 415/206 |

FOREIGN PATENT DOCUMENTS

| | | | |
|---|---|---|---|
| 153221 | 8/1985 | European Pat. Off. | 416/188 |
| 907976 | 8/1945 | France . | |
| 204622 | 11/1907 | Germany . | |
| 2405795 | 1/1975 | Germany | 416/206 |
| 138899 | 6/1986 | Japan | 416/188 |
| 81778 | 5/1953 | Norway | 416/188 |
| 675279 | 9/1990 | Switzerland . | |
| 13134 | of 1913 | United Kingdom | 415/206 |
| 555888 | 9/1943 | United Kingdom | 416/228 |

*Primary Examiner*—John T. Kwon

*Attorney, Agent, or Firm*—Oblon, Spivak, McClelland, Maier & Neustadt

[57] ABSTRACT

In a stabilizing device for extending the characteristic diagram of a compressor, which consists of a ring permanently attached to the impeller vanes of the impeller and a recess in the casing of the compressor in the form of a rotationally symmetrical groove, the ring is limited to the inlet region of the impeller and attached there in such a way that on rotation of the impeller, the ring can be moved in the recess, there being only a conventional close clearance between the ring and the wall of the casing. Due to this structure, the formation of a gap flow from the side of the vane at high pressure to that at low pressure is prevented, which leads to an increase in the efficiency of the compressor and to the widening of the compressor characteristic. The vibration loading on the vanes is lowered at the same time.

2 Claims, 1 Drawing Sheet

STABILIZING DEVICE FOR EXTENDING THE CHARACTERISTIC DIAGRAM OF A COMPRESSOR

BACKGROUND OF THE INVENTION

1. Field of the Invention

The invention relates to a stabilizing device for extending the characteristic diagram of a compressor.

2. Discussion of Background

It is known that during the rotation of a compressor impeller, a gap flow appears in the gap between the rotating outer edges of the impeller vanes and the stationary casing, this flow taking place from the side of the vane at high pressure to that at low pressure. Together with other flow phenomena in the inlet part of the centrifugal impeller, this gap flow can lead to a vortex. Due to this vortex, the efficiency of the compressor is reduced and the stable range of the compressor characteristic becomes narrower.

When turbo-compressors are used, an attempt is made to achieve a steadily falling characteristic, without hysteresis, as the flow increases in order to achieve a high level of reliability during part-load operation. Such continuous characteristics are described as being stable. As the pressure ratio at the design point is increased, however, stable characteristics become more difficult to achieve at part load. For this reason, attempts are made to generate the desired stable characteristics by means of additional stabilizing devices.

The stabilizing device described, for example, in the Patent Specification CH 675 279 consists of a recess in the casing of a centrifugal compressor, a stabilizing ring being integrated in this recess. The recess and the stabilizing ring are arranged in front of the impeller and outside the main flow. Stabilizing vanes are present at the outer periphery of the stabilizing ring and these are anchored on the inner contour of the recess. The disadvantage of this solution consists in the complicated design of the casing, the ring and the stabilizing vanes. In addition, the vibration loading of the impeller vanes in the inlet region, which is large in any case, is further increased by the stabilizing appliance.

A stabilizing device is known to the applicant in which the disadvantages just mentioned are reduced. This device consists of a ring permanently connected to the impeller vanes, a relatively large radial recirculation passage being arranged between the ring and the casing of the compressor. When the compressor is strongly throttled, a recirculation flow is made possible there and this contributes to stabilizing the characteristic diagram. The ring supports the vane inlet edges in both the radial and tangential directions and, by this means, reduces the vane vibrations. The disadvantage of this solution consists in the necessity for a relatively large recirculation passage and the fact that for many centrifugal compressors, the recirculation is undesirably strong.

SUMMARY OF THE INVENTION

Accordingly, one object of the invention is to avoid all these disadvantages and to prevent the formation of the damaging gap flow from one side of the vane to the other in the impeller inlet region of a compressor and, by this means, to extend the compressor characteristic diagram by stabilizing the flow and, at the same time, to obviate the vibration problems in the impeller inlet region.

In accordance with the invention, this is achieved in that the stabilizing device consists of a ring permanently attached to the impeller vanes and a recess in the casing of the compressor in the form of a rotationally symmetrical groove, the ring being attached in the inlet region of the impeller in such a way that on rotation of the impeller, the ring can be moved in the recess, there being only a conventional close clearance between the ring and the wall of the casing.

The advantages of the invention may, inter alia, be seen in that no vortices or only vortices to a decreased extent occur in the inlet part of the impeller. This leads to the efficiency of the compressor being increased and the stable region of the compressor characteristic being widened. At the same time, the vanes are supported in the tangential and radial directions by the ring so that the vibration load decreases. Because the ring is limited to the inlet part of the impeller only and the radius there is smaller than it is at the impeller outlet, the centrifugal loading is relatively small and can, therefore, be overcome.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein an embodiment example of the invention is represented using a centrifugal compressor and the single figure shows a partial meridional section of the compressor with the stabilizing device.

DESCRIPTION OF THE PREFERRED EMBODIMENTS

Figure 1:
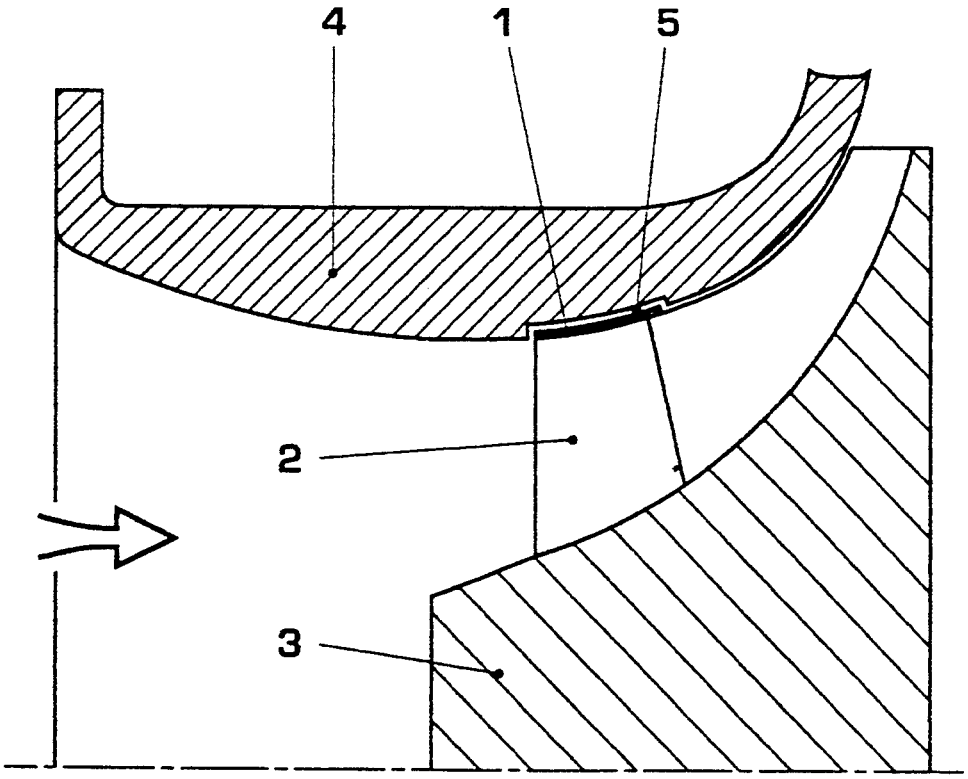

Referring now to the drawing, in which only the elements essential to understanding the invention are shown and the flow direction of the working medium is indicated by an arrow, a part of a centrifugal compressor with the stabilizing device according to the invention is represented in the figure.

The compressor consists of the casing 4 and the impeller 3. The impeller 3 is equipped with a ring 1, which is in the form of a short shroud plate and is permanently connected to the impeller vanes 2. This shroud plate is limited to the inlet part of the impeller 3. A recess 5 in the form of a rotationally symmetrical groove is present in the casing 4 of the compressor.

The dimensions of the recess 5 are matched to the dimensions of the ring 1 in such a way that the ring 1 can move freely in the recess 5 during the rotation of the impeller 3 but that only the conventional close clearance is present between the ring 1 and the wall of the casing 4. This close clearance is also, for example, present between the upper edges of the impeller vanes 2 and the wall of the casing 4.

The ring 1 supports the vane inlet edges in the radial and tangential directions. This leads to the vane vibration amplitudes being greatly reduced and the mechanical loading on the vanes decreasing. Because the ring 1 is limited to the inlet part of the impeller 3, where the radius is substantially smaller than at the impeller outlet, the centrifugal load is also substantially smaller and can therefore be overcome. Destruction of the ring 1 due to excessive centrifugal force does not therefore occur.

The ring 1 rotating with the impeller 3 in the recess 5 prevents the formation of the gap flow over the outer edges of the vanes in the impeller region in which the gap flow would contribute to the formation of a damaging vortex. Because of this, the vortex does not occur at all or only to a reduced extent. The efficiency of the compressor is increased by this means and the stable range of the compressor characteristic is widened.

What is claimed as new and desired to be secured by Letters Patent of the United States is:

1. A stabilizing device for extending a characteristic diagram of a compressor, the stabilizing device comprising:

a ring attached to a flow inlet region of an impeller vane of a compressor, the compressor having a casing which comprises a recess, said recess defining a rotationally symmetrical groove which corresponds to said ring, said ring being positioned within said recess, said recess being sized so as to provide for a close clearance between the ring and the casing and permit a rotation of said ring within said recess upon rotation of said impeller vane.

2. A stabilizing device according to claim 1, wherein said recess surrounds said ring such that said close clearance is defined between an upper portion of said ring and said casing, and opposite side portions of said ring and said casing.

* * * * *